US006068392A

United States Patent [19]

Ohtaki et al.

[11] Patent Number: 6,068,392

[45] Date of Patent: May 30, 2000

[54] MOTOR VEHICLE ELECTRIC LAMP HAVING LENS WITH SIDE RIDGES AND REFLECTOR EXTENSION WITH MOUNTING FINS

[75] Inventors: Sumito Ohtaki; Kenichi Nakayama, both of Shimizu, Japan

[73] Assignee: Koito Manufacturing Co., Ltd., Tokyo, Japan

[21] Appl. No.: 09/097,807

[22] Filed: Jun. 16, 1998

[30] Foreign Application Priority Data

Jun. 17, 1997 [JP] Japan ..... 9-159620

[51] Int. Cl.[7] ..... F21V 15/01

[52] U.S. Cl. ..... 362/546; 362/517; 362/518; 362/520; 362/304; 362/305; 362/306

[58] Field of Search ..... 362/546, 517, 362/518, 520, 304, 305, 306

[56] References Cited

U.S. PATENT DOCUMENTS

| | | | |
|---|---|---|---|
| 4,212,051 | 7/1980 | Kulik | 362/546 |
| 4,569,007 | 2/1986 | Dick | 362/546 |
| 5,070,432 | 12/1991 | Kitazumi et al. | 362/538 |
| 5,546,284 | 8/1996 | Harada | 362/459 |

FOREIGN PATENT DOCUMENTS

| | | | |
|---|---|---|---|
| 0 054 444 | 6/1982 | European Pat. Off. | F21M 3/20 |
| 0 591 015 | 11/1994 | European Pat. Off. | F21M 7/00 |
| 7826096 | 8/1979 | Germany | F21S 1/12 |
| 34 15 442 | 10/1984 | Germany | F21M 7/00 |
| 8326661 | 1/1985 | Germany | F21V 17/00 |
| 196 43 461 | 4/1988 | Germany | F21M 7/00 |
| 44 43 682 | 6/1996 | Germany | F21M 7/00 |
| 195 35 704 | 3/1997 | Germany | F21M 7/00 |
| 197 35 325 | 3/1998 | Germany | F21M 3/08 |

*Primary Examiner*—Sandra O'Shea
*Assistant Examiner*—Ronald E. DelGizzi
*Attorney, Agent, or Firm*—Sughrue, Mion, Zinn, Macpeak & Seas, PLLC

[57] ABSTRACT

A motor vehicle headlight is disclosed which has a lamp body having a open front end closed by a lens to define a lighting chamber, and a light source with a reflector mounted in the lighting chamber. Also disposed in the lighting chamber is a reflector extension of approximately tubular shape interposed between the reflector and the lens for concealing the gaps between the reflector and the lamp body. The reflector extension has a mounting fin extending upwardly therefrom which is frictionally engaged between the lamp body and the lens, thereby dispensing with fasteners. Extending downwardly from the reflector extension, another mounting fin may be screwed to either the lens or the lamp body because the screws under the reflector extension are hardly visible from outside the headlight in its use on a motor vehicle.

10 Claims, 4 Drawing Sheets

MOTOR VEHICLE ELECTRIC LAMP HAVING LENS WITH SIDE RIDGES AND REFLECTOR EXTENSION WITH MOUNTING FINS

BACKGROUND OF THE INVENTION

This invention relates generally to electric lamps, particularly to those for use on motor vehicles as, for example, headlamps, and more particularly to vehicles lamps of the type having a reflector extension or an inner lens in a lighting chamber defined by a lamp body and a lens. Still more particularly, the invention deals with how to mount such an inner member in the lighting chamber.

The vehicle headlamp has been known and used extensively wherein a light source together with a reflector is mounted in a lighting chamber formed by bonding a lens to the open front end of a lamp body. It has also been common with this type of headlamp to mount a reflector extension between lens and reflector in the lighting chamber. Approximately in the shape of a short tube, the reflector extension is intended to conceal the gaps between lamp body and reflector. Heretofore, the reflector extension has been mounted in the lighting chamber by having its top and bottom marginal edges screwed to the top and bottom rims of the lens turned rearwardly therefrom.

An objection to this conventional method of reflector extension mounting is that it requires screws or like fasteners, which add to lamp parts and which make lamp assemblage very troublesome and time-consuming. Another objection is that the fasteners, particularly those fixing the reflector extension to the top rim of the lens, are visible from above the lamp when the automobile hood is opened. The externally visible fasteners are undesirable from an esthetic point of view.

The same objections hold true with those vehicular headlamps in which an inner lens is fastened interiorly of the above mentioned lens with a view to beam pattern control. The invention is equally well applicable to electric lamps having a reflector extension, to those having an inner lens, or those having both. Therefore, hereinafter in this specification, the generic name "inner member" will be used where necessary to mean either the reflector extension, the inner lens, or any other essentially equivalent part.

SUMMARY OF THE INVENTION

The present invention has it as an object, in electric lamps of the type defined, to make the mounting of an inner member easier and quicker than heretofore.

Another object of the invention is to reduce the component parts of such lamps.

Another object of the invention is to enhance the esthetic appearance of such lamps.

Briefly, the invention may be summarized as an easy-to-assemble, esthetically appealing electric lamp for use as a vehicular headlight, among other applications. The lamp comprises a lamp body having an open end, a lens closing the open end of the lamp body and coacting therewith to define a lighting chamber, light source means mounted in the lighting chamber, and an inner member mounted in the lighting chamber and disposed between the lens and the light source means. Characteristically, the inner member is frictionally engaged, at least in part, between the lamp body and the lens in order to dispense with fastener means.

The inner member, be it a reflector extension, an inner lens or anything else, may be wholly frictionally engaged as above, or alternatively partly frictionally engaged and partly screwed or otherwise fastened to the lens or to the lamp body. Either way, less screws or other fasteners are needed than if the inner member is not at all frictionally supported. Moreover, when used as a vehicle headlight, the lamp will be more esthetically favorable if fasteners are absent from its visible part, even if they are used at its invisible part for stability.

The above and other objects, features and advantages of this invention will become more apparent, and the invention itself will best be understood, from a study of the following description and appended claims, with reference had to the attached drawings showing some preferable embodiments of the invention.

DESCRIPTION OF THE PREFERRED EMBODIMENTS

Figure 1:
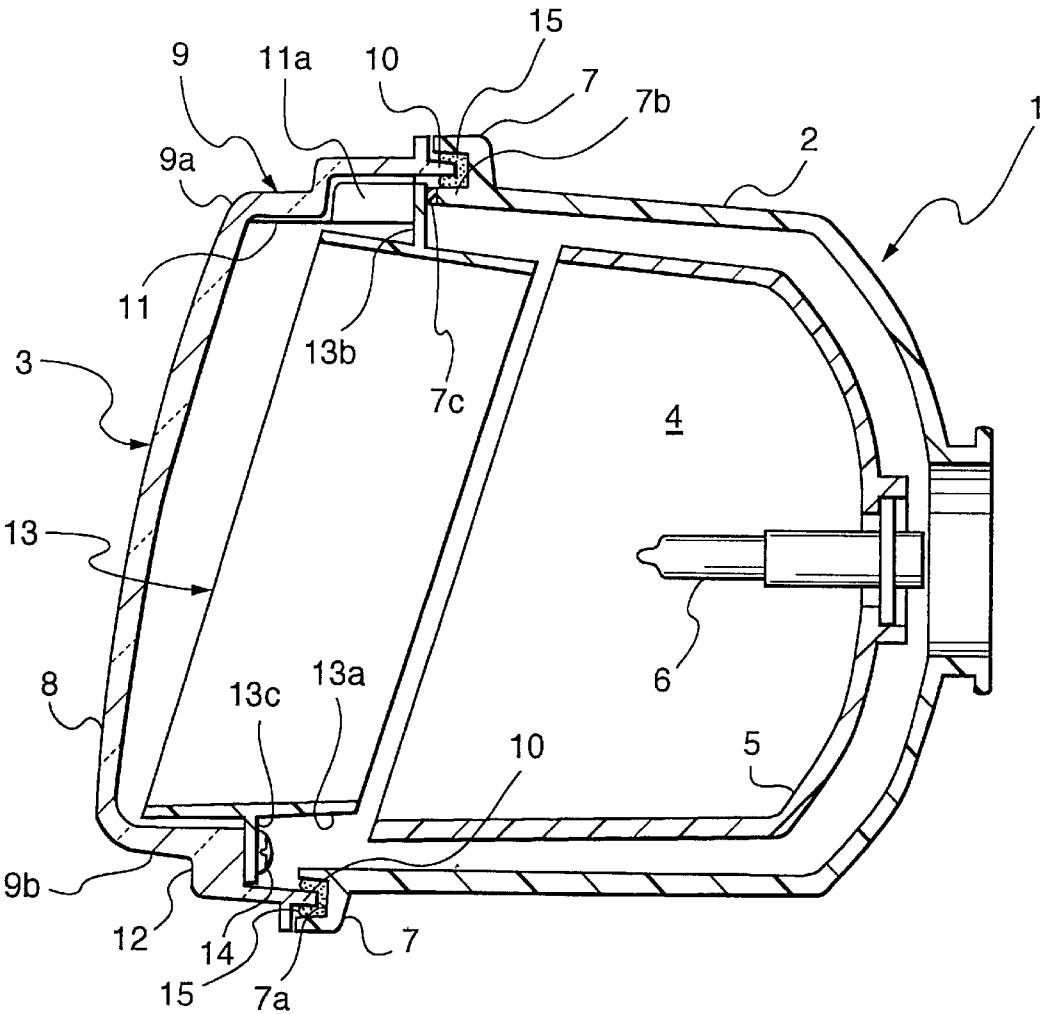
FIG. 1 is a vertical section through a motor vehicle headlamp embodying the principles of this invention.

The present invention will now be described in detail as embodied in the motor vehicle headlamp of FIGS. 1–3 by way of example. Generally designated 1 in FIG. 1, the exemplified headlamp includes a lamp body 2 having a closed rear end shown directed to the right in this figure and an open front end. With this front end closed by a lens 3, the lamp body 2 defines a lighting chamber 4 in which there is conventionally mounted a reflector 5 with a light source such as an electric lighting bulb 6 supported centrally thereof. The reflector 5 reflects the light rays from the light source 6 and redirects them forwardly of the lamp 1 through the lens 3.

Also mounted in the lighting chamber 4 is a reflector extension 13 which is disposed between lens 3 and reflector 5. This invention particularly concerns how to support the reflector extension 13 in the lighting chamber 4.

Figure 2:
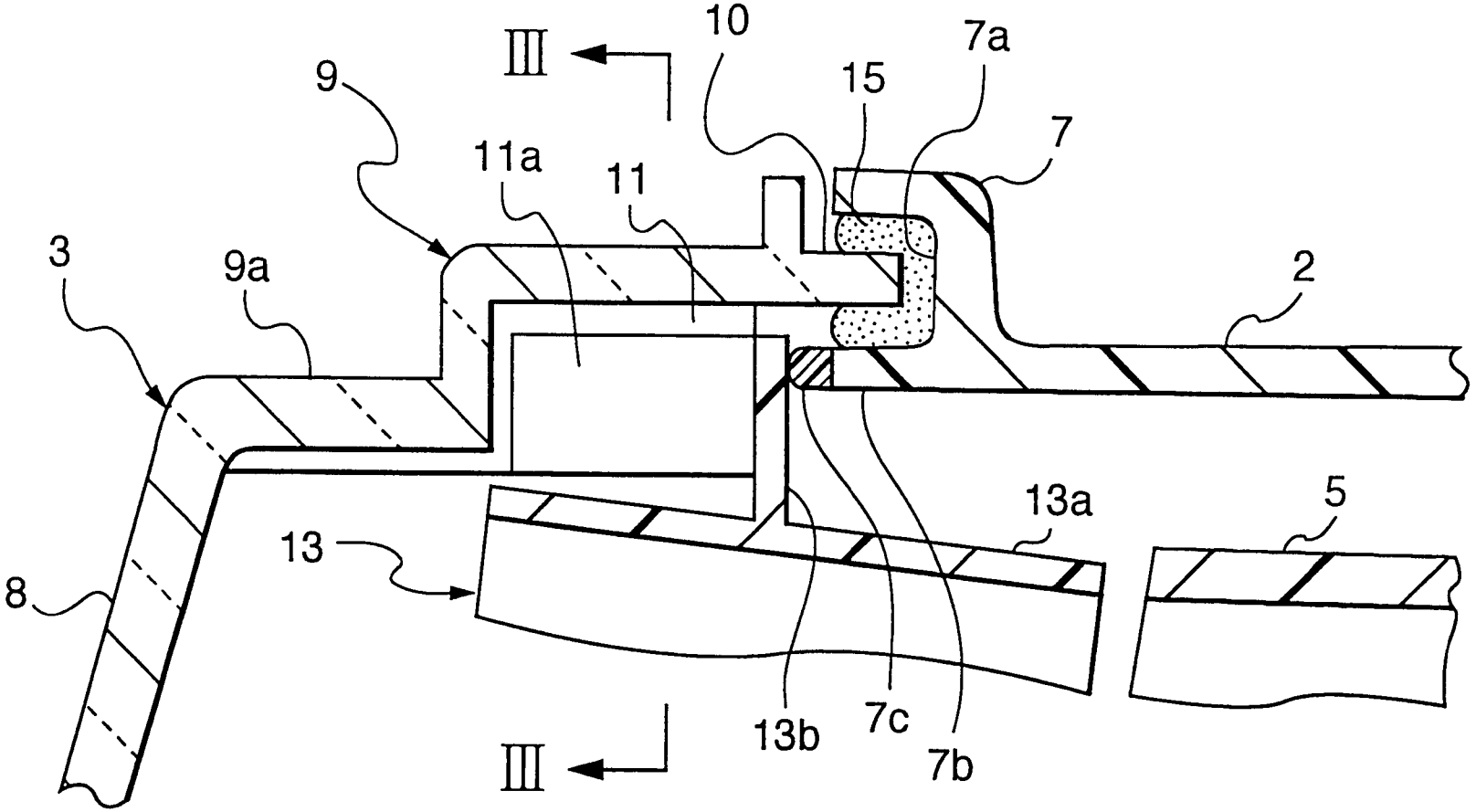
FIG. 2 is a section taken along the same plane as FIG. 1 but showing part of the headlamp on an enlarged scale.

Molded from a plastic, the lamp body 2 has a set of rims 7 of L shaped cross section extending along its front edges to define lens-mounting grooves 7*a,* as shown also in FIG. 2 on an enlarged scale. The upper front edge 7*b* of the lamp body 2 has a plurality of spaced bosses 7*c,* one seen in both FIGS. 1 and 2, projecting forwardly therefrom for frictionally engaging the reflector extension 13.

The lens 3 is molded from a transparent vitreous or plastic material to include a major portion 8 closing the front end of the lamp body 2, and a set of annular rims 9 turned rearwardly from the peripheral edges of the major portion. The rims 9 terminate at their rear ends in tongues 10 received in the grooves 7*a* in the lamp body 2.

The top rim 9*a* of the lens 3 is stepped to provide two horizontal sections in offset arrangement. As shown on a still more enlarged scale in FIG. 3, the top rim 9*a* has formed on its underside a multiplicity of ridges 11 extending parallel to each other in the front-to-rear depth direction of the headlamp 1. Each semicylindrical in shape, the ridges 11 are intended to make the lamp interior less visible from above.

Figure 3:
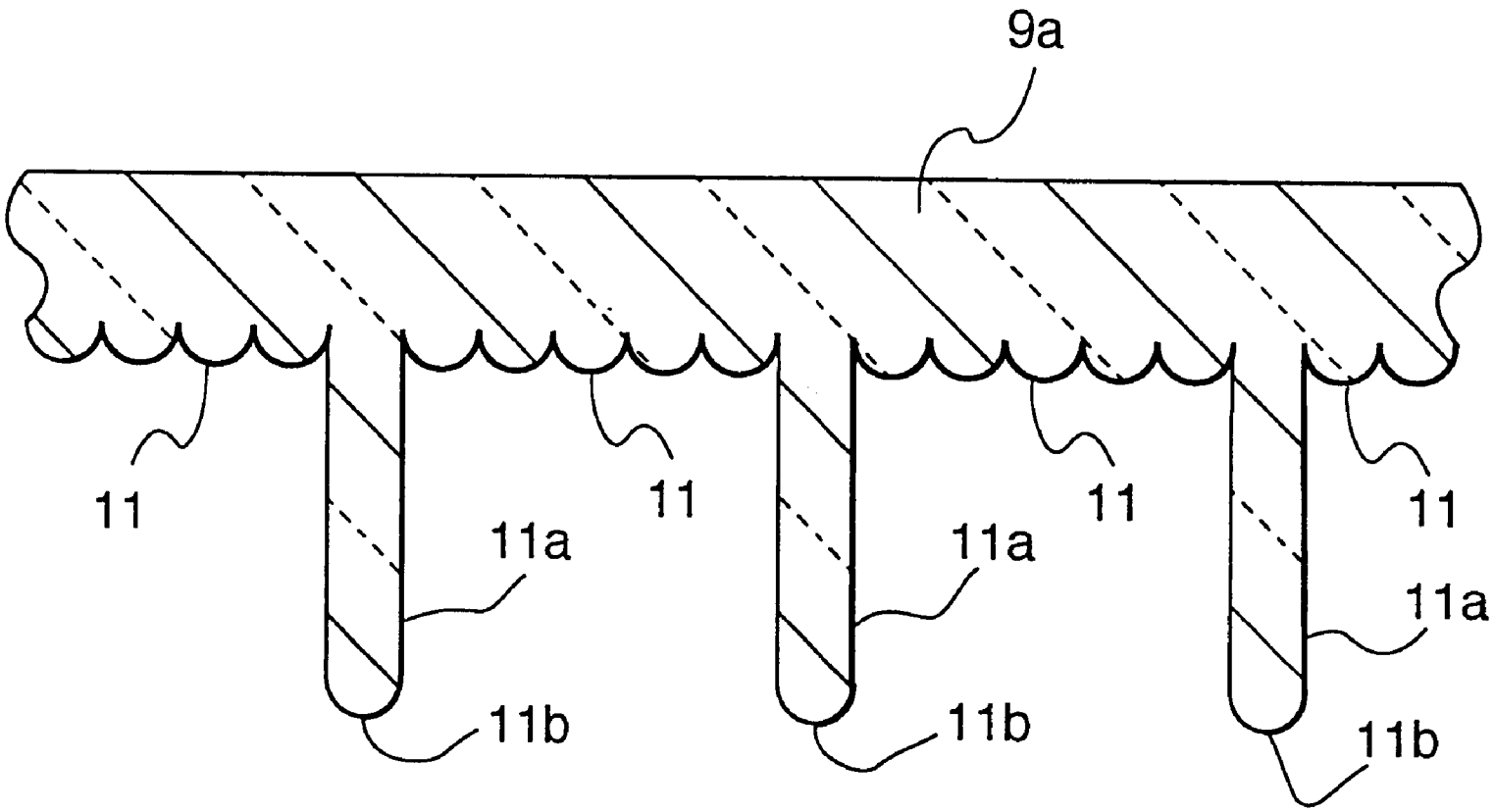
FIG. 3 is a still more enlarged section taken along the line III—III in FIG. 2.

As indicated at 11*a* in FIG. 3, some of the ridges 11, shown to be every sixth in this particular embodiment, on the rear top rim section extend farther down than the other ridges, to the same level as the ridges on the front top rim section. These taller ridges 11*a* coact with the bosses 7*c* on the front, top edge of the lamp body 2 for frictionally engaging part of the reflector extension 13 in a manner yet to be described. The tips 11*b* of the taller ridges 11*a* are of the same semicylindrical shape as the shorter ridges 11, so that the taller ridges are virtually inconspicuous among the shorter ridges. The esthetic aspect of the headlamp 1 is therefore not to suffer from the presence of these taller ridges.

FIG. 1 shows that the bottom rim 9*b* of the lens 3 is similar in cross-sectional configuration to the top rim 9*a,* having two horizontal, offset sections with a ledge 12 therebetween. The ledge 12 is, however, made thicker than the similar ledge of the top rim 9*a* to receive screws 14 in fastening the reflector extension 13 to the lens 3.

Intended to conceal the gaps between lamp body 2 and reflector 5, the reflector extension 13 has a major portion 13*a* in the shape of a short tube, a top mounting fin 13*b* extending upwardly therefrom, and a bottom mounting fin 13*c* extending downwardly therefrom. Typically, the reflector extension 13 is a one-piece molding of polycarbonate or the like, preferably with vapor deposition of aluminum or like material to appear silver or gold.

In assembling the headlamp 1 the bottom mounting fin 13*c* of the reflector extension 13 may be screwed at 14 to the thickened ledge 12 of the bottom rim 9*b* of the lens 3 before attaching this lens to the lamp body 2. Then, with the top mounting fin 13*b* held against the rear ends of the taller ridges 11*a* on the top lens rim 9*a,* the annular tongues 10 of the lens may be inserted in the grooves 7*a* in the lamp body 2 and held fast therein by means of an adhesive 15. The assemblage of the headlamp 1 has now been completed.

Upon completion of the bonding of the lens 3 to the is lamp body 2 as above, the top mounting fin 13*b* of the reflector extension 13 will be firmly frictionally captured between the taller ridges 11*a* of the lens and the bosses 7*c* of the lamp body. This frictional engagement of the top mounting fin 13*b,* combined with the fastening of the bottom mounting fin 13*c* to the bottom lens rim 9*b,* suffices to hold the reflector extension 13 against displacement in the face of the most severe of vibrations and shocks that may be exerted on the headlamp in its usage on a motor vehicle.

It should be appreciated that the top mounting fin 13*b* contacts only with the rear ends of the taller ridges 11*a* on the lens and with the bosses 7*c* on the lamp body. This assures firmer contact between the parts despite possible dimensional errors or deformations of such parts. Further the frictional supporting of the top mounting fin dispenses with fasteners that have been heretofore employed to affix the fin to the lens or to the lamp body. As an additional advantage the frictional engagement of the top mounting fin between lens and lamp body is far less troublesome and time-consuming than turning two or more screws for fastening it.

Screws are used at 14 to secure the bottom mounting fin 13*c* to the lens 3. Hidden by the reflector extension 13, however, these screws are hardly visible even when the vehicle hood is opened. The use of screws here is therefore preferable to the thorough dispensation with fasteners from the viewpoints of the resulting ease of lamp assemblage and the firmness of reflector extension mounting.

Figure 4:
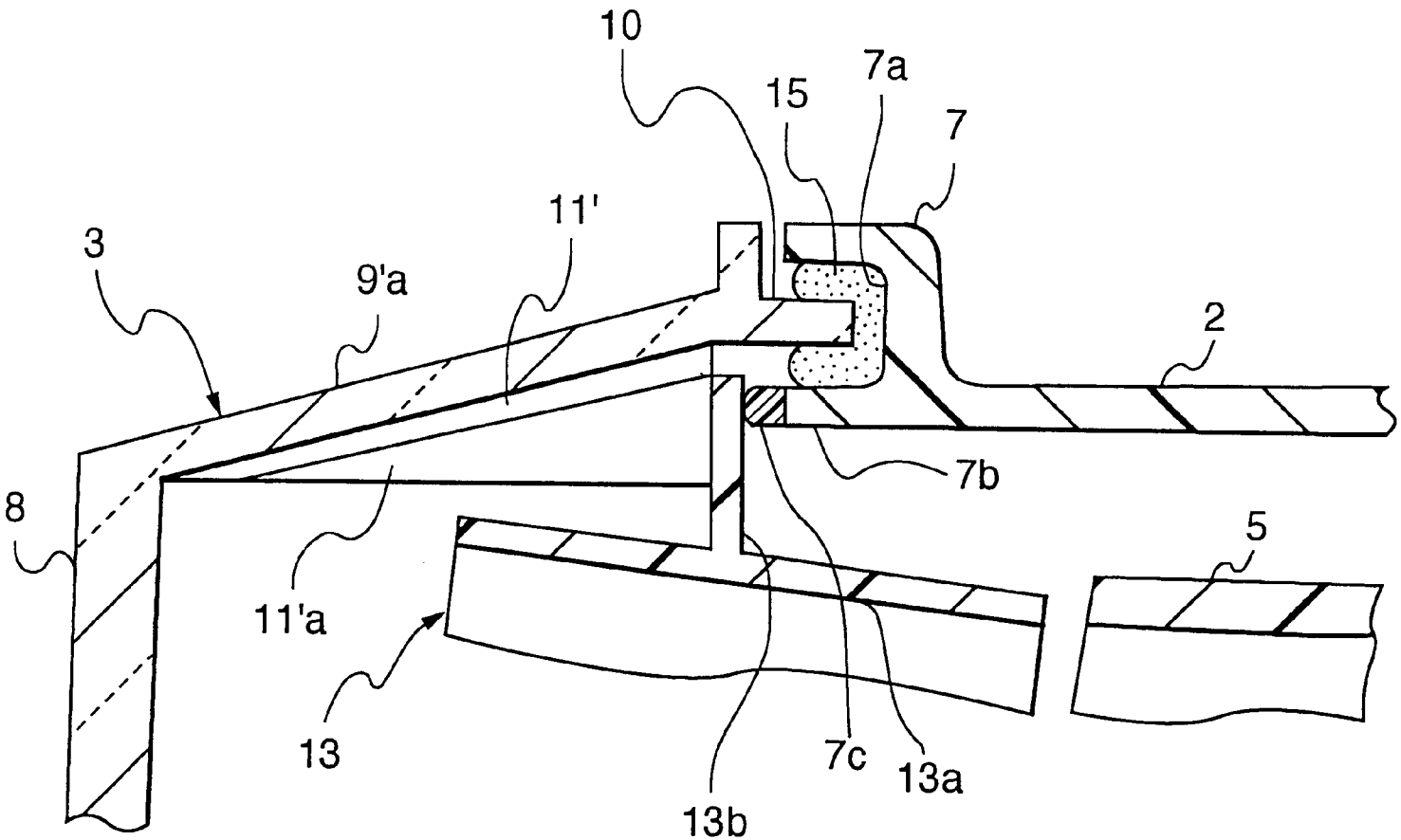
FIG. 4 is a view similar to FIG. 2 but showing an alternate headlamp according to this invention.

FIG. 4 shows a modified headlamp according to this invention in which the lens 3 has a top rim 9'*a* which is angled upwardly as it extends rearwardly from the major lens portion 8, without any ledge or step formed in the middle. The top rim 9'*a* has a multiplicity of semicylindrical ridges 11' formed on its underside. Some 11*a* of the ridges are made gradually taller than the others as they extend rearwardly. The top mounting fin 13*b* of the reflector extension 13 is frictionally caught between the bosses 7*c* on the lamp body 2 and the taller ridges 11'*a* on the lens rim 9'*a*. The other constructional details of this modified headlamp are the same as those of the FIGS. 1–3 headlamp 1.

Despite the foregoing detailed disclosure it is not desired that the invention be limited by the exact showing of the drawings or the description thereof. For instance, screws or other fasteners could be wholly eliminated by frictionally engaging the bottom mounting fin of the reflector extension by the same method as its top mounting fin. It is also understood that the invention is applicable to supporting not only a reflector extension, as in the illustrated embodiments, but also an inner lens for beam pattern control, as well as both reflector extension and inner lens.

A variety of additional modifications, alterations or adaptations of the illustrated embodiments will suggest themselves to one skilled in the art, in order to conform to design preferences or to meet the requirements of each specific application of the invention, without departure from the proper scope or fair meaning of the subjoined claims.

What is claimed is:

1. An electric lamp for use as a vehicular headlight, the lamp comprising:

(a) a lamp body having an open end;

(b) a lens closing the open end of the lamp body and coacting therewith to define a lighting chamber, the lens having a periphery with an inner side at a junction of the lens and the lamp body;

(c) a light source mounted in the lighting chamber; and (d) an inner member comprising at least one of a tube-shaped reflector extension and an inner lens, and having a fin, the inner member being mounted in the lighting chamber, and disposed between the lens and the light source, the fin of the inner member being frictionally engaged without fasteners between the lamp body and the inner side of the periphery of the lens.

2. The electric lamp of claim 1 wherein:

the electric lamp has a lengthwise axis extending from the light source through the lens;

the lens is has parallel ridges formed along at least part of the inner side of the periphery, the ridges being substantially parallel with the lengthwise axis and extending from the inner side of the periphery in a direction substantially perpendicularly toward the lengthwise axis, some of the ridges being taller than the other ridges in the direction of the lengthwise axis, and the fin of the inner member is frictionally engaged between the lamp body and the taller ridges of the lens.

3. The electric lamp of claim 2 wherein the taller ridges have a semicylindrical shape at the end furthest from the inner side of the periphery of the lens, and wherein the other ridges also end in a semicylindrical shape.

4. The electric lamp of claim 1 wherein the lamp body is formed to include a plurality of spaced bosses for frictionally holding the fin of the inner member against the lens.

5. The electric lamp of claim 2 wherein the lamp body is formed to include a plurality of spaced bosses for frictionally holding the fin of the inner member against the lens.

6. A motor vehicle headlight comprising:

(a) a lamp body having an open end;

(b) a lens closing the open end of the lamp body and coacting therewith to define a lighting chamber, the lens having a periphery with an inner side at a junction of the lens and the lamp body;

(c) a light source and a reflector mounted in the lighting chamber; and (d) a reflector extension disposed between the lens and the reflector inside the lighting chamber, the reflector extension having a first mounting fin frictionally engaged between the lamp body and the lens without a fastener, and a second mounting fin secured to the lens by a fastener.

7. The motor vehicle headlight of claim 6 wherein:

the motor vehicle headlight has a lengthwise axis extending from the light source through the lens;

the lens is has parallel ridges formed along at least part of the inner side of the periphery, the ridges being substantially parallel with the lengthwise axis and extending from the inner side of the periphery in a direction substantially perpendicularly toward the lengthwise axis, some of the ridges being taller than the other ridges in the direction of the lengthwise axis, and the first mounting fin of the reflector extension is frictionally engaged between the lamp body and the taller ridges of the lens.

8. The motor vehicle headlight of claim 7 wherein the taller ridges have a semicylindrical shape at the end furthest from the inner side of the periphery of the lens, and wherein the other ridges also end in a semicylindrical shape.

9. The motor vehicle headlight of claim 6 wherein the lamp body is formed to include a plurality of spaced bosses for frictionally holding the first mounting fin of the reflector extension against the lens.

10. The motor vehicle headlight of claim 7 wherein the lamp body is formed to include a plurality of spaced bosses for frictionally holding the first mounting fin of the reflector extension against the lens.

* * * * *